United States Patent [19]

Grach

[11] Patent Number: 4,879,943

[45] Date of Patent: Nov. 14, 1989

[54] EXPANSIBLE CHAMBER MOTOR WITH SNAP-ACTING VALVE

[75] Inventor: Ayzik Grach, Creve Coeur, Mo.

[73] Assignee: McNeil (Ohio) Corporation, St. Paul, Minn.

[21] Appl. No.: 194,833

[22] Filed: May 17, 1988

[51] Int. Cl.[4] ..... F01L 15/12; F01L 21/04; F01B 7/18

[52] U.S. Cl. ..... 91/224; 91/229; 91/235; 91/321; 91/346; 91/417 R; 91/422; 251/75

[58] Field of Search ..... 91/235, 222, 224, 229, 91/321, 344, 346, 417, 422; 251/75

[56] References Cited

U.S. PATENT DOCUMENTS

| | | | |
|---|---|---|---|
| 2,091,390 | 8/1937 | Forman | 91/224 |
| 2,419,859 | 4/1947 | Tarr et al. | 91/346 X |
| 2,987,051 | 6/1961 | Goyette et al. | 91/224 |
| 3,233,628 | 2/1966 | Hammelmann | 91/229 X |
| 4,127,057 | 11/1978 | Stubenruss | 91/229 X |
| 4,610,192 | 9/1986 | Hartley et al. | 91/346 X |

FOREIGN PATENT DOCUMENTS

| | | | |
|---|---|---|---|
| 210041 | 11/1955 | Australia | 91/229 |
| 1298752 | 7/1969 | Fed. Rep. of Germany | 91/224 |
| 2508568 | 11/1982 | France | 91/346 |

*Primary Examiner*—Robert E. Garrett
*Assistant Examiner*—Mark A. Williamson
*Attorney, Agent, or Firm*—Senniger, Powers, Leavitt and Roedel

[57] ABSTRACT

This invention relates to an air motor having a snap-acting overcentering spring mechanism for snapping the valving of the air motor between first and second positions as the piston completes each stroke in the cylinder to ensure reliable stall-free operation of the motor.

7 Claims, 2 Drawing Sheets

EXPANSIBLE CHAMBER MOTOR WITH SNAP-ACTING VALVE

BACKGROUND OF THE INVENTION

This invention relates to expansible chamber motors, and more particularly to a reciprocating air motor of this class.

The invention is especially directed to a reciprocating air motor comprising a piston reciprocable in a cylinder with valving mechanism incorporated in the piston for controlling the delivery to and exhaust of air from the cylinder on opposite sides of the piston to effect reciprocation of the piston.

Attention is directed to the following U.S. patents found in a search on the invention and considered in the preparation of this application: 2,863,600, 3,094,938, 3,737,254, 4,325,285, 4,521,963, 4,610,192.

SUMMARY OF THE INVENTION

Among the several objects of the invention may be noted the provision of an improved motor of the class described specially for driving low pressure pumps for transferring low viscosity materials, e.g. various liquids including water-based solutions, etc.; and the provision of such a motor which is fully automatically operable reliably at different speeds in a generally stall-proof manner.

Briefly, an expansible chamber motor (an air motor) of the present invention comprises a cylinder, a piston reiprocable in the cylinder, and a piston rod extending from the piston through one end of the cylinder. The piston divides the cylinder into a first chamber between the piston and said one end of the cylinder and a second chamber between the piston and the other end of the cylinder. The cylinder has an inlet for delivery of pressure air thereto to said first chamber. The piston has passaging or communication from the first to the second chamber. The piston and piston rod has a passage for exhaust of air from the second chamber with a valve seat at the end of said passage open to said second chamber. Valve means is carried by the piston for opening and closing said passaging in the piston and said exhaust passage. The valve means is movable relative to the piston between a first position wherein said passaging in the piston is open and said exhaust passage is closed and a second position wherein said passaging in the piston is closed and said exhaust passage is open, said valve means having a part on the side of the piston toward said one end of the cylinder which is arrested as the piston completes a stroke toward said one end of the cylinder to effect relative movement of the piston and valve means to said second position of the valve means and having a part on the other side of the piston which is arrested as the piston completes a stroke toward the other end of the cylinder to effect relative movement of the piston and the valve means to said first position of the valve means a snap-acting overcentering spring means is interposed between the piston and said valve means for snapping said valve means from its said first position to its said second position as the piston completes a stroke toward said one end of the cylinder, and for snapping said valve means from its said second position to its said first position as the piston completes a stroke toward said other end of the cylinder.

Other objects and features will be in part apparent and in part pointed out hereinafter.

BRIEF DESCRIPTION OF THE DRAWINGS

Corresponding reference numerals indicate corresponding parts throughout the several views of the drawings.

DESCRIPTION OF THE PREFERRED EMBODIMENT

Figure 1:
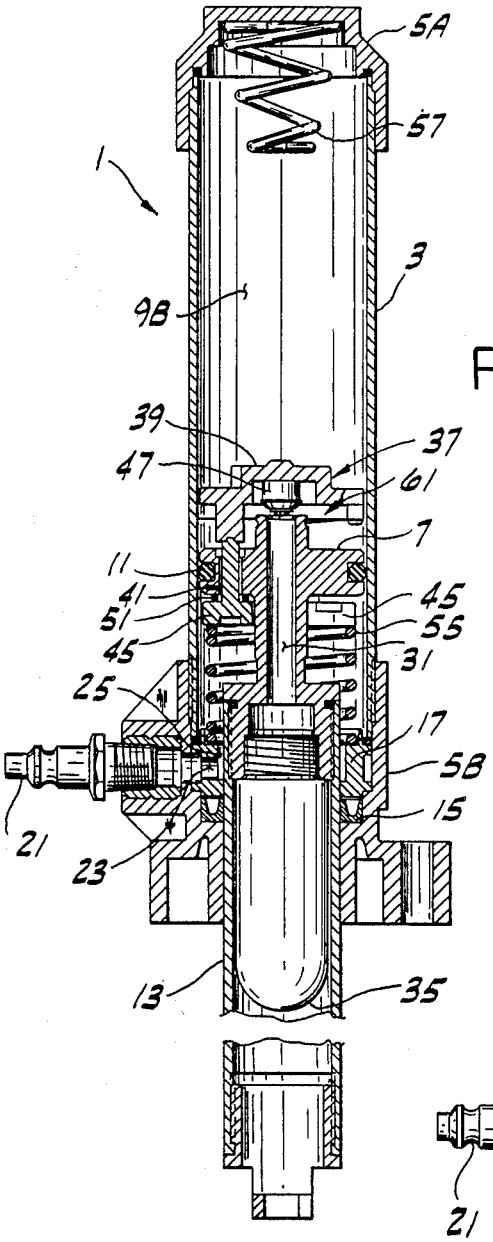
FIG. 1 is a longitudinal section of an air motor of this invention showing the piston at one end of its stroke.
Figure 2:
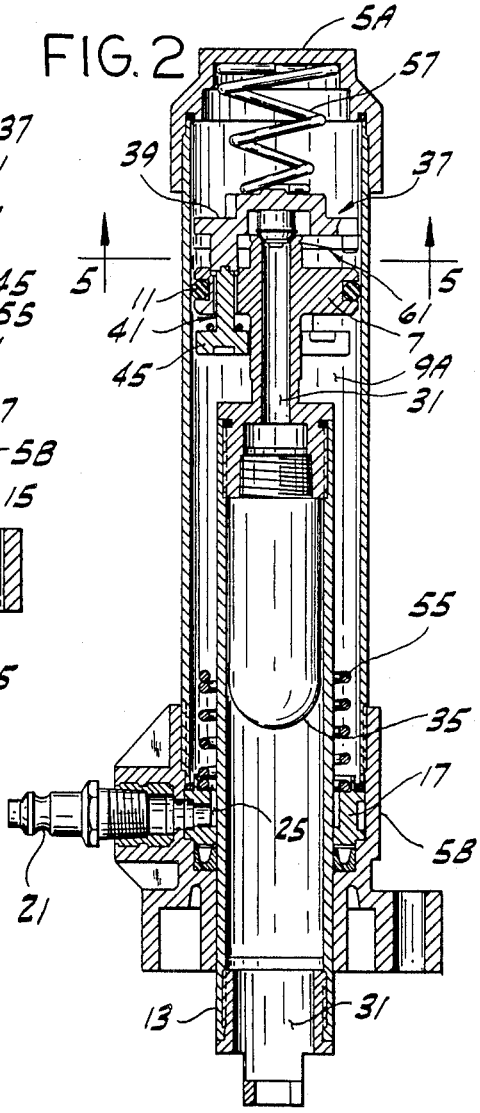
FIG. 2 is a view similar to FIG. 1 showing the piston at the other end of its stroke.
Figure 3:
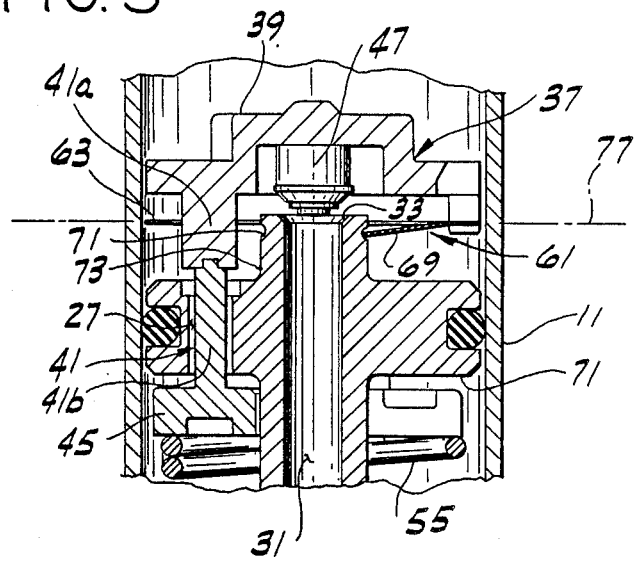
FIG. 3 is an enlarged portion of FIG. 1 showing a snap-acting spring mechanism in one configuration.
Figure 4:
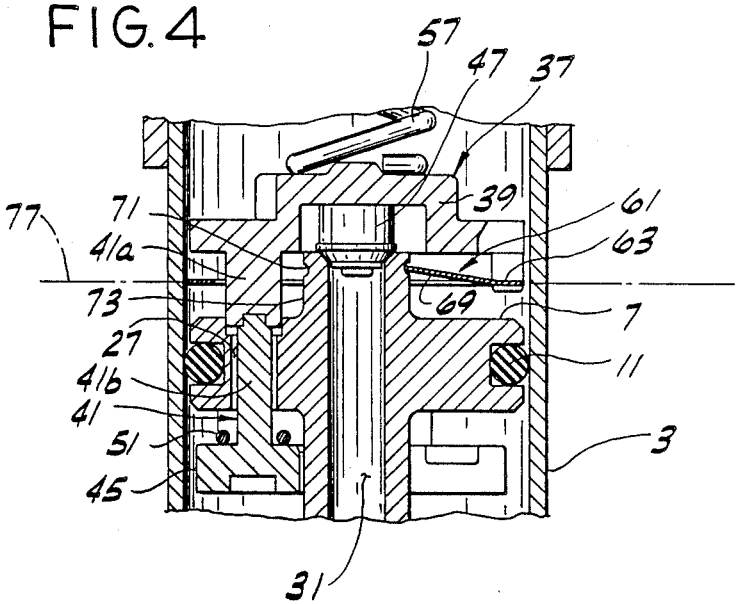
FIG. 4 is an enlarged portion of FIG. 2 showing the snap-acting spring mechanism in another configuration.

Referring to the drawings, there is generally indicated at 1 an expansible chamber motor and specifically an air motor of this invention, comprising a cylinder 3 (which in use generally occupies a vertical position as shown in FIGS. 1 and 2) having upper and lower end heads designated 5A and 5B, respectively. These heads are secured (e.g., threaded) on the upper and lower ends of the cylinder 3 in conventional fashion. A motor piston 7 is reciprocable up and down in the cylinder between the end heads and divides the cylinder into a first (lower) chamber 9A between the piston and lower end head 5B and a second (upper) chamber 9B between the piston and upper end head 5A. An O-ring seal 11 received in a groove in the enlarged head of the piston seals against the cylinder wall as the piston reciprocates in the cylinder. The piston is fastened on the end of a piston rod 13 which extends down from the piston through the lower end head 5B. A sealing ring 15 of generally channel shape in vertical section is held in place on the lower end head by an annular retainer 17 and seals against the piston rod 13 at the point where it extends down through the lower end head 5A.

Indicated at 21 is an inlet fitting having a bore therethrough constituting an inlet for delivery of pressure fluid (air) to the lower chamber 9A of the cylinder. It will be noted in this regard that pressure air is adapted to flow through the inlet fitting 21, through a radial passage 23 in retainer 17, and thence up through an annular space 25 between the retainer and the piston rod 13 into the lower chamber 9A. Communication is provided between the upper and lower chambers 9A, 9B of the cylinder by passaging comprising a plurality of vertical bores 27 through the piston spaced at equal intervals around the piston. The piston 7 and piston rod 13 have a longitudinal passage 31 therethrough extending generally axially of the cylinder 3 for exhaust of air from the upper chamber 9B, the upper end of passage being open to the upper chamber and chamfered to provide a valve seat 33. A noise suppressor 35 is provided in passage 31.

Valve means comprising a valve member, generally indicated at 37, is carried by the piston for opening and closing the bores 27 and the exhaust passage 31. Specifically, valve member 37 includes a circular valve cap 39 having a plurality of legs, each designated 41, depending from the valve cap and extending down through bores 27 in the piston 7, and a foot 45 at the lower end of each leg. The legs have cross-sections smaller than the diameters of the bores 27 to provide annular spaces for flow of air therethrough from the lower chamber 9A to the upper chamber 9B. A valve sealing member 47 positioned centrally of the valve cap on the underside thereof is provided for sealing against the valve seat 33 at the upper end of the exhaust passage 31. O-rings, each designated 51, on the legs 41 immediately above the feet 45 are provided for sealing against the bottom of the piston 7 to close the annular portions of bores 27 not occupied by the legs 41. The legs 41 are longer than bores 27 so that the valve member 37 is moveable relative to the piston 7 between a first (FIG. 2) position wherein the annular portions of the bores 27 in the piston are open and the exhaust passage 31 is closed by valve sealing member 47 and a second (FIG. 1) position wherein the annular portions of the bores 27 in the piston are closed by O-ring seals 51 and the exhaust passage 31 is open. The drawings illustrate three bores 27 and three 41 legs spaced at 120° intervals around the piston and cap, respectively; but it will be understood that this number may vary. To facilitate assembly, each leg 41 comprises an upper part 41*a* integral with the valve cap 39 and a lower part 41*b* initially separate from the upper part. The two parts are permanently connected together after assembly of the valve member 37 with the piston.

A coil compression spring 55 around the piston rod 13 at the lower end of the cylinder bears on retainer 17. The spring is engageable by a part (feet 45) of the valve member 37 to arrest the valve member as the piston completes its downstroke toward the lower end of the cylinder and to effect relative movement of the piston and the valve member 37 to the stated second (FIG. 1) position of the valve member. A second coil compression spring 57 depends from the upper end head 5A at the upper end of the cylinder and is engageable by a part (valve cap 39) of the valve member to arrest the valve member as the piston completes its upstroke toward the upper end of the cylinder and to effect relative movement of the piston and the valve member 37 to the stated first (FIG. 2) position of the valve member.

Figure 5:
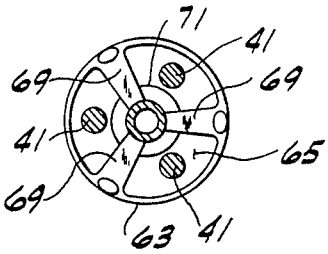
FIG. 5 is a sectional view taken on line 5—5 of FIG. 2.

In accordance with this invention, a snap-acting overcentering spring means generally indicated at 61 is interposed between the piston and the valve cap 39 for snapping the valve member 37 from its stated second (FIG. 1) position to its stated first (FIG. 2) position as the piston completes its upstroke, and for snapping the valve member from its stated first (FIG. 2) position to its stated second (FIG. 1) position as the piston completes its downstroke. More particularly, snap-acting spring means 61 comprises a ring 63 affixed (e.g., bolted) to the valve cap 39 and having a central opening 65 therethrough generally coaxial with the cylinder 3, and spring finger means in the form of a plurality of spring fingers 69 formed integrally with the ring and projecting inwardly therefrom at substantially equal angular intervals (e.g., 120° ) around the ring, as shown in FIG. 5. The spring fingers 69 terminate in tips received in a narrow groove 71 around the upper end 73 of the piston 7, the tips thus being axially affixed to the piston to prevent axial movement of the tips relative to the piston. As illustrated in FIG. 5, three spring fingers 69 are preferred, but it will be understood that more than three may be used without departing from the scope of this invention, the only limitation being that, if the ring 63 is disposed between the valve cap 39 and piston, there should be sufficient space between the spring fingers for passage of legs 41 of the valve member 37 (see FIG. 5).

The spring fingers 69 are so dimensioned in length that they are in substantial compression when the spring fingers are in the plane 77 of the ring 63, the result being that the fingers will naturally tend to spring to a position of less stress, which is a conical configuration on one or the other side of the plane of the ring. Thus, as will appear, the spring fingers are adapted to snap through the ring 63 from a coned position on one side of the ring to a coned position on the other side of the ring as the piston completes each stroke in the cylinder thereby to snap the valve member 37 between its stated first and second positions shown in FIGS. 1 and 2. It is preferred that the spring fingers 69 be so dimensioned that they are under some compression even when coned, thereby ensuring that the valve member is forced to the extreme limits of its travel for full and proper seating of respective sealing members 47 and 51. It is contemplated that snap-acting spring means 61 may interconnect the piston and valve member 37 at other locations, such as between the piston and the bottom (e.g., feet 45) of the valve member.

Referring first to FIG. 1, the operation of the air motor will now be described. In the position shown, the piston 7 has completed a downstroke so that the valve member is in its stated second position in which the bores 27 in the piston are closed by O-rings 51 and the exhaust passage 31 is open. As working fluid (pressure air) is introduced into inlet 21 and delivered to the lower chamber 9A of the cylinder via passages 23 and 25, the piston will be forced through an upstroke, with the air in the upper chamber 9B exhausting through passage 31 as the piston travels upwardly. During tee upstroke, the spring fingers 69 are coned downwardly to hold the valve member at its maximum separation from the piston to ensure that the O-rings 51 seal tight against bores 27. As the piston approaches the upper end of the cylinder, the valve cap 39 of the valve member 37 engages and compresses the upper coil spring 57, which serves to arrest the valve member and to effect downward movement of the valve member relative to the piston. During this downward relative movement, the downwardly coned spring fingers 69 will flatten into the plane 77 of the ring at which point, since the spring fingers are in substantial compression, they will snap up through the plane of the ring to a position in which they are upwardly coned. The snap action of the spring fingers will exert a downward force on the valve member 37 sufficient to effect a quick and positive snap-action of the valve member down to its stated first (FIG. 2) position wherein the valve sealing member 47 is seated on valve seat 33 to close the exhaust passage 31, and wherein the O-rings 51 are spaced below the bottom of the piston for permitting pressure air to pass through bores 27 from the lower chamber 9A of the cylinder to the upper chamber 9B of the cylinder. The positive snap action of the valve member 37 to its FIG. 2 position prevents stalling of the air motor at the completion of its upstroke.

As pressure air is introduced into the upper chamber 9B, the piston will be forced through a downstroke (since the pressure air in the upper chamber 9B acts on a greater piston area than the pressure air in the lower chamber 9A). During the downstroke, the spring fingers 69 are coned upwardly to hold the valve member at its minimum separation from the piston to ensure that the valve sealing member 47 is seated tight against seat 33. As the piston approaches the lower end of the cylinder, the feet 45 of the valve member 37 engage and compress the lower coil spring 55, which serves to arrest the valve member and to effect upward movement of the valve member relative to the piston. During this upward relative movement, the upwardly coned spring fingers 69 will flatten into the plane 77 of the ring at which point, since the spring fingers are in substantial compression, they will snap down through the plane of the ring to a position in which they are downwardly coned. The snap action of the spring fingers will exert an upward force on the valve member sufficient to effect a quick snap-action of the valve member up to its stated second (FIG. 1) position, whereupon the piston is ready for another upstroke. The positive snap action of the valve member 37 to its FIG. 1 position prevents stalling of the air motor at the completion of its downstroke.

It will be apparent, therefore, that the snap-acting spring mechanism 61 of the present invention ensures a quick and complete snap action of the valve member 37 between its stated first and second positions at the completion of each stroke of the piston in the cylinder, thereby providing for reliable stall-free operation of the air motor.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An expansible chamber motor comprising a cylinder, a piston reciprocable in the cylinder, a piston rod extending from the piston through one end of the cylinder, the piston dividing the cylinder into a first chamber between the piston and said one end of the cylinder and a second chamber between the piston and the other end of the cylinder, the cylinder having an inlet for delivery of pressure air thereto to said first chamber, the piston having passaging for communication from the first to the second chamber, the piston and piston rod having a passage for exhaust of air from the second chamber with a valve seat at the end of said passage open to said second chamber, valve means carried by the piston for opening and closing said passaging in the piston and said exhaust passage, said valve means being movable relative to the piston between a first position wherein said passaging in the piston is open and said exhaust passage is closed and a second position wherein said passaging in the piston is closed and said exhaust passage is open, said valve means having a part on the side of the piston toward said one end of the cylinder which is arrested as the piston completes a stroke toward said one end of the cylinder to effect relative movement of the piston and valve means to said second position of the valve means and having a part on the other side of the piston which is arrested as the piston completes a stroke toward the other end of the cylinder to effect relative movement of the piston and the valve means to said first position of the valve means, and a snap-acting overcentering spring means interposed between the piston and said valve means for snapping said valve means from its said first position to its said second position as the piston completes a stroke toward said one end of the cylinder, and for snapping said valve means from its said second position to its said first position as the piston completes a stroke toward said other end of the cylinder, the snap action of said valve means between its said first and second positions preventing stalling of the air motor as the piston completes its strokes, said spring means comprising a ring affixed to one of said valve means and piston and having a central opening therethrough generally coaxial with said cylinder, and spring finger means on the ring affixed to the other of said valve means and piston, said spring finger means being in substantial compression when in the plane of the ring whereby said spring finger means is adapted to snap through the plane of the ring from a coned position on one side of the ring to a coned position on the opposite side of the ring as the piston completes each stroke in the cylinder, the snap-action of said spring finger means exerting a force on said valve means sufficient to snap the valve means to its said first or second position.

2. A motor as set forth in claim 1 wherein said spring finger means is under compression when coned thereby to exert a force on said valve member tending to hold the valve member in its said first position during a stroke of the piston toward said one end of the cylinder and in its said second position during a stroke of the piston toward said other end of the cylinder.

3. A motor as set forth in claim 1 wherein said ring is affixed to said valve means and said spring finger means comprises a plurality of spring fingers projecting inwardly from said ring and terminating in tips affixed to said piston, said spring fingers being so dimensioned in length that they are in compression when in the plane of the ring and being adapted to snap through said plane in a direction toward said one end of the cylinder as the piston completes a stroke toward said one end of the cylinder and to snap through said plane in a direction toward said other end of the cylinder as the piston completes a stroke toward said other end of the cylinder.

4. A motor as set forth in claim 3 wherein said tips of said spring fingers are received in a groove in said piston to prevent axial movement of the tips of the spring fingers relative to the piston.

5. A motor as set forth in claim 4 wherein said ring and said spring fingers are integrally formed.

6. A motor as set forth in claim 5 wherein said spring finger means comprises at least three spring fingers arranged at substantially equal angular intervals around said ring.

7. A motor as set forth in claim 6 wherein said first and second parts of said valve means are connected by legs extending through passages in the piston and through said central opening in the ring between said spring fingers.

* * * * *